United States Patent [19]

Focke

[11] Patent Number: 4,960,234

[45] Date of Patent: Oct. 2, 1990

[54] APPARATUS FOR SEPARATING WEBS OF MATERIAL INTO (TWO) PART WEBS

[75] Inventor: Heinz Focke, Verden, Fed. Rep. of Germany

[73] Assignee: Focke & Co. (GmbH & Co.), Verden, Fed. Rep. of Germany

[21] Appl. No.: 252,083

[22] Filed: Sep. 30, 1988

[30] Foreign Application Priority Data

Oct. 1, 1987 [DE] Fed. Rep. of Germany ..... 3733129

[51] Int. Cl.[5] ..... B65H 23/26; B23Q 15/22

[52] U.S. Cl. ..... 226/15; 242/56.5; 83/73; 226/18

[58] Field of Search ..... 226/15, 16, 17, 18, 226/19, 20, 21, 22, 23; 242/56.4, 56.5; 83/73, 359

[56] References Cited

U.S. PATENT DOCUMENTS

| | | | |
|---|---|---|---|
| 3,599,849 | 8/1971 | Callan | 226/22 |
| 3,752,377 | 8/1973 | Knapp | 226/17 X |
| 4,049,213 | 9/1977 | Hank et al. | 226/19 X |
| 4,204,619 | 5/1980 | Damour | 226/21 |
| 4,477,006 | 10/1984 | Sharp | 226/21 X |
| 4,572,417 | 2/1986 | Joseph | 226/20 |
| 4,627,319 | 12/1986 | Mattei et al. | 83/73 |

FOREIGN PATENT DOCUMENTS 3502009 5/1985 Fed. Rep. of Germany .

*Primary Examiner*—Daniel P. Stodola
*Assistant Examiner*—Paul T. Bowen
*Attorney, Agent, or Firm*—Sughrue, Mion, Zinn, Macpeak & Seas

[57] ABSTRACT

Packaging machines are often supplied with a web of packaging material of double width. During transport, the web of material (11) is sub-divided into two part webs (12,13) by means of a central longitudinal cut. The exact run of the web of material (11) and of the part webs (12,13) is monitored by edge-sensing members (21; 25,26). Any deviations from the correct position are transmitted as error signal to web-adjusting members (24; 27,28). These are each equipped with two deflecting rollers (32,33 or 59,60 or 62,63) arranged at a distance from one another and intended for deflecting the web of material (11) or part web (12,13). The two deflecting rollers are each adjusted in order to adjust the web run.

10 Claims, 7 Drawing Sheets

APPARATUS FOR SEPARATING WEBS OF MATERIAL INTO (TWO) PART WEBS

BACKGROUND OF THE INVENTION

The invention relates to an apparatus for continuously separating a web of material into at least two part webs, especially in conjunction with a packaging machine, the web of material and the part webs being guided respectively via adjustable deflecting members, especially pivotable deflecting rollers, the position of which is controllable by means of monitoring members for the web of material and for the individual webs.

In packaging machines of especially high performance, particularly for the packaging of cigarettes, often webs of material of packaging material, for example paper, tinfoil, film etc., are supplied in double widths and, before the production of blanks, are divided into two part webs by means of a severing cut in the longitudinal mid-plane of the web of material. The part webs then have the width necessary for the size of the blank. This method of feeding the packaging material is especially advantageous on double-web packaging machines.

It is necessary to monitor both the exact central execution of the severing cut and the run of the part webs formed as a result of the severing cut to the folding or other further-processing members. For this purpose, monitoring members are assigned to the web of material and to the part webs which, when there are variations in the position, adjust guide members, especially deflecting rollers for the web of material and for the part webs.

The object on which the invention is based is to develop further an apparatus of the type mentioned in the introduction, to the effect that, whilst being of simple design, it makes it possible to set the web of material and the individual webs to an exact run in an especially sensitive way.

SUMMARY OF THE INVENTION

To achieve this object, the apparatus according to the invention is characterized in that the web of material and/or the part webs are guided respectively via two jointly adjustable (pivotable) deflecting rollers of a web-adjusting member.

Web-adjusting members reacting especially accurately and sensitively are assigned to the web of material and to the part webs and each consists of two oppositely driven deflecting rollers arranged at a distance from one another. These are adjusted jointly in order to adjust the web run, with the result that even very small regulating movements are sufficient to ensure an appropriate adjustment of the web run.

The two deflecting rollers of a web-adjusting member are arranged on a common roller-carrier which is jointly pivoted in order to execute web adjustments. For this, according to the invention, a servo-motor, in particular, a stepping motor, is used and, in response to regulating signals from the opto-electrical monitoring members, causes the necessary regulating movements via a spindle mechanism. The roller-carriers, in turn, are mounted as a pivotable unit on a supporting frame connected to the machine structure.

In the region of the part webs, two roller-carriers designed to project are respectively arranged pivotably on a common supporting frame and are adjustable via separate servo-motors with an associated spindle. The relative arrangement of the two roller-carriers in relation to one another is such that leading rollers are mounted immediately adjacent to one another. This allows a substantially parallel guidance of the two part webs after the severing cut. The trailing deflecting rollers of the two roller-carriers are arranged at a longer distance from one another, so that a diverging guidance of the part webs occurs in the region between the two deflecting rollers of the roller-carriers.

Further features of the invention refer to the arrangement of web-adjusting members and monitoring members, the guidance of the webs and the constructive design of the web-adjusting members.

An exemplary embodiment of the invention is explained in detail below with reference to the drawings. In these:

DETAILED DESCRIPTION OF PREFERRED EMBODIMENT

Figure 1:
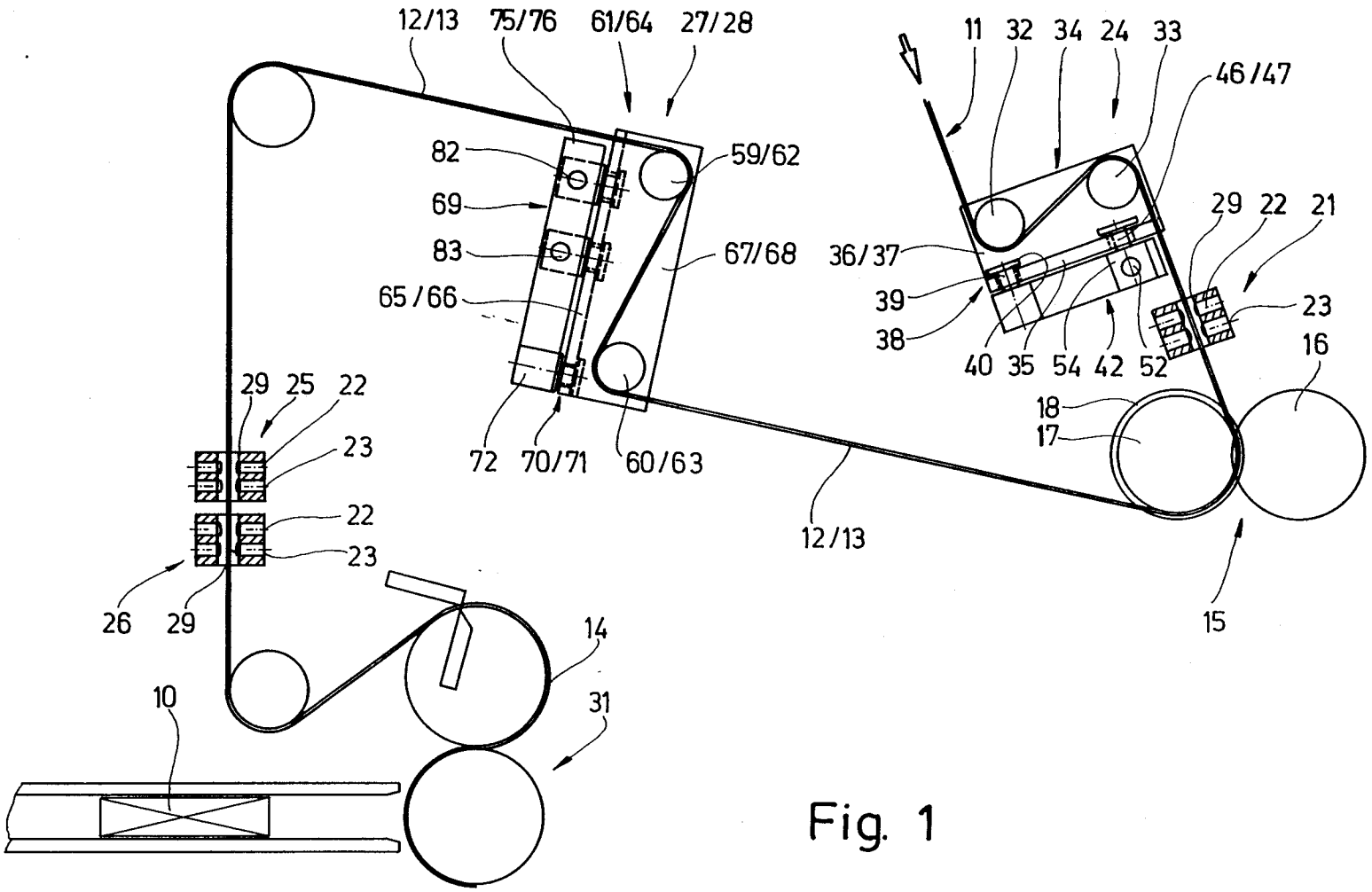
FIG. 1 shows a diagrammatic side view of the entire web-severing apparatus.

The apparatus shown a$ an exemplary embodiment is used in conjunction with packaging machines, especially for the production of cigarette packs. The packaging material can be tinfoil as an inner wrapping for a cigarette group 10.

The packaging material is supplied as a web of material 11 of double width. This is drawn off continuously from a reel (not shown). Two part webs 12, 13 are formed from the web of material 11 of double width by severing the latter centrally. These are of such width that they are suitable for producing individual blanks 14 by severing from one part web 12, 13 or the other.

The central severing cut will be made as accurately as possible while the web of material is running. This purpose is served by a severing unit 15 consisting, in the present exemplary embodiment, of a circular severing knife 16 and of a backing roller 17, over the circumference of which the web of material 11 is guided. The backing roller 17 is equipped with a narrow encircling groove 18 which matches the disc-shaped severing knife 16. The latter partially enters the groove 18. A lateral limitation of this forms a cutting edge 19, against which the severing knife 16 comes to bear with an outer edge region in order to make the severing cut. The severing knife 16 is arranged on the end face of a knife shaft 20. The two members, namely the severing knife 16 and the backing roller 17, are driven in rotation according to the conveying speed of the web of material 11.

Figure 2:
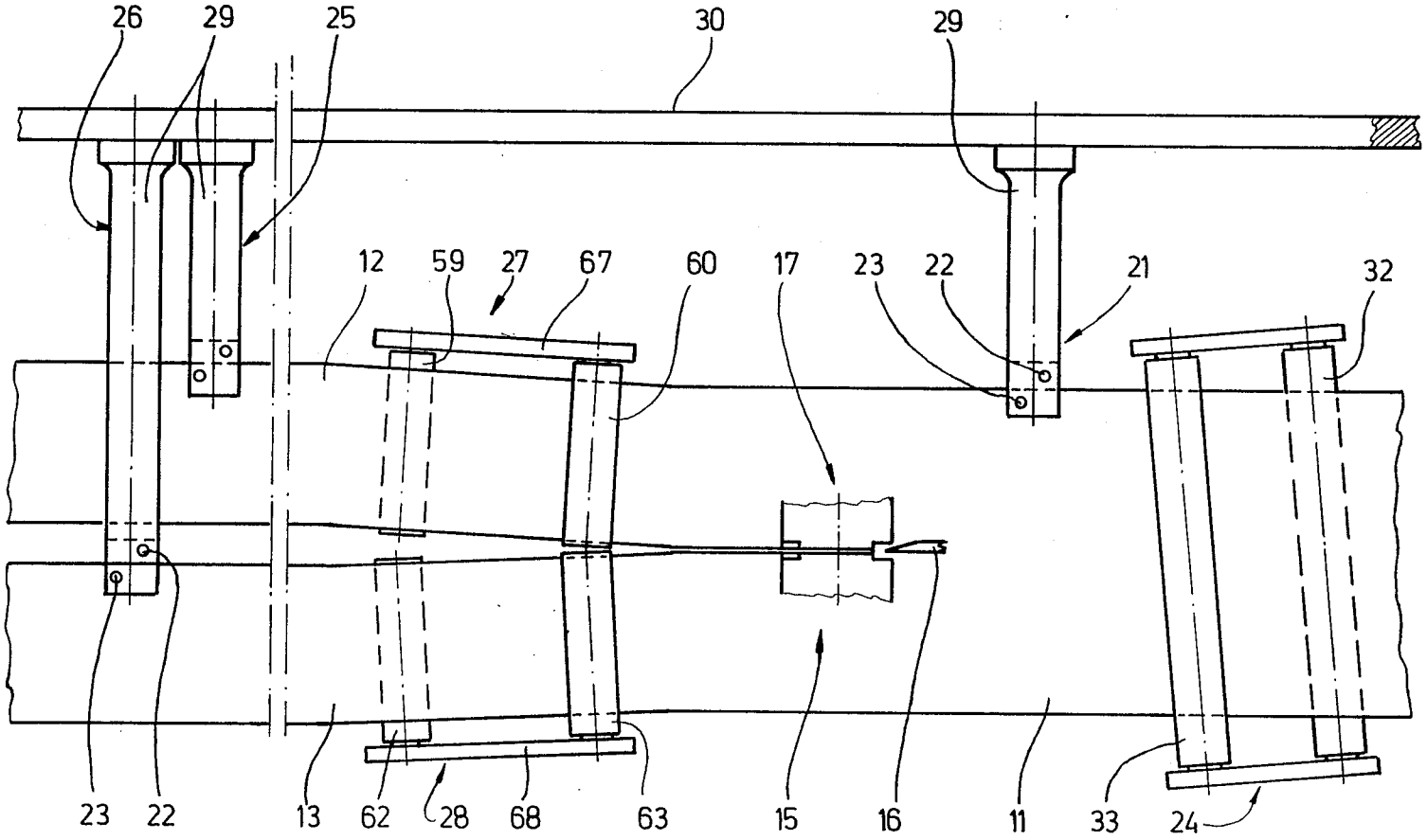
FIG. 2 shows a plan-view representation of FIG. 1 on an enlarged scale, with a simplified representation of individual members.

The relative position of the web of material 11 and of the part webs 12 and 13 is monitored by sensing members. As is evident especially from FIG. 2, the first opto-electrical edge-sensing member 21 is assigned to the web of material 11, specifically at a short distance in front of the severing unit 15 in the conveying direction of the web of material 11. The edge-sensing member 21 is equipped, here, with two pairs of photosensors 22 and 23 arranged offset, which are located above and below the web of material 11 on both sides of a lateral edge of the latter. Variations in the relative position of the running web of material 11 are recorded by this edge-sensing member 21 and converted into a control signal for the web-adjusting member 24.

Separate edge-sensing members 25 and 26 of the type described are also assigned respectively to the two part webs 12 and 13. These act on web-adjusting members 27 and 28 for the respective part webs 12 and 13. The edge-sensing members 21, 25 and 26 are mounted on a lateral machine cheek 30 by means of supporting arms 29 projecting on one side.

The edge-sensing members 25, 26 serve for checking and maintaining the exact relative position of the running part webs 12, 13 and are therefore mounted adjacent to a processing station 31, in which the blanks 14 are produced by severing the part web 12, 13.

The web-adjusting members 24 on the one hand and 27, 28 on the other hand are designed in a special way. The web-adjusting member 24 intended for the individual web of material 11 consists of two deflecting rollers 32, 33 arranged at a distance from one another. These are mounted rotatably on a common supporting member, in particular, on a roller-carrier 34. This consists of a rectangular supporting plate 35 elongated according to the length of the deflecting rollers 32, 33 and of transversely directed bearing flanges 36, 37 at the ends. The deflecting rollers 32, 33 are mounted rotatably in the bearing flanges 36, 37.

The roller-carrier 34 is adjustable, particularly pivotable as a unit about an eccentric pivot bearing 38. This consists of a short bearing bolt 39 with a collar 40 at the end. The bearing bolt 39 passes through a bore 41 in the supporting plate 35.

The roller-carrier 34 is mounted by means of the so designed pivot bearing 38 on a stationary supporting frame 42. This consists, in the present case, of a supporting arm 43 which extends approximately in the direction of the deflecting rollers 32, 33 and which, here, is connected to the machine cheek 30. Transversely directed or upright supporting legs 44, 45 for the additional support of the roller-carrier 34 are arranged on the supporting arm 43.

The pivot bearing 38 or the bearing bolt 39 is connected to the supporting arm 43, specifically in the present case, in the transverse mid-plane of the supporting plate 35, but offset relative to the longitudinal mid-plane of the latter. An offset centre of rotation is therefore obtained for the roller-carrier 34 and consequently for the deflecting rollers 32, 33. This centre of rotation is located approximately in the region of the leading deflecting roller 32 for the web of material 11. In contrast, the second trailing deflecting roller 33 is at a longer distance from the pivot bearing 38.

For additional support, the supporting plate 35 is connected movably to the supporting legs 44, 45 via connecting bolts 46, 47. The connecting bolts 46, 47 mounted on the supporting legs 44, 45 enter long holes 49 of the supporting plate 35 which are in the form of an arc of a circle.

The deflecting rollers 33, 32 are driven in rotation by the web of material 11. As illustrated, the looping-round regions of the deflecting rollers 32, 33 are on opposite sides. The diagonal run of the web of material 11 between the deflecting rollers 32, 33 is obtained. The deflecting rollers 32, 33 are thereby driven in opposite directions.

The arrangement described ensures that even very slight adjusting movements of the roller-carrier 34 cause a variation in the running direction of the web of material 11, specifically in response to control signals from the edge-sensing member.

In the present exemplary embodiment, the control signals are transmitted to a servo-motor 48 which, here, is designed as a stepping motor and which is mounted on the machine cheek 30 on the side located opposite the web-adjusting member 24. A motor shaft 87 is connected, via a coupling 50, to a regulating mechanism for the roller-carrier 34.

In the exemplary embodiment illustrated, the pivoting movements are caused by a regulating spindle 51. A spindle rod 52 of this is connected to the motor shaft 87 via the coupling 50. In a middle region between the supporting legs 44, 45, the spindle rod 52 is equipped with a spindle thread 53. This is in engagement with a spindle nut 54 which itself is mounted on the supporting plate 35 via a rotary connection 55. The rotary connection 55 is appropriately designed in the manner of the pivot bearing 38.

The regulating spindle 51 i$ arranged at a distance from the pivot bearing 38, in particular at the upper or free ends of the supporting legs 44, 45. The spindle rod 52 is mounted rotatably in these. In the region of one supporting leg 45, the spindle rod 52 is secured against axial shifts by means of thickened rod portions 56, 57.

The above-described regulating mechanism also allows manual adjustments of the roller-carrier 34. For this purpose, a handwheel 58 is mounted on the free end of the regulating spindle 51. This serves especially for the coarse adjustment of the supporting plate 35.

The web-adjusting members 27 and 28 for the part webs 12, 13 are designed in a similar way. Deflecting rollers 59, 60 for one part web 12 are mounted on the first roller-carrier 61 and corresponding deflecting rollers 62, 63 on a second roller-carrier 64. The roller-carriers 61 and 64 are of identical design, in particular with a supporting plate 65, 66 and each with only one bearing flange 67, 68 located at the edge. The latter are arranged on mutually distant sides of the supporting plates 65, 66. Here, the deflecting rollers 59, 60 and 62, 63 are mounted rotatably on the respective associated bearing flanges 67, 68 on one side in an overhanging manner.

Figure 4:
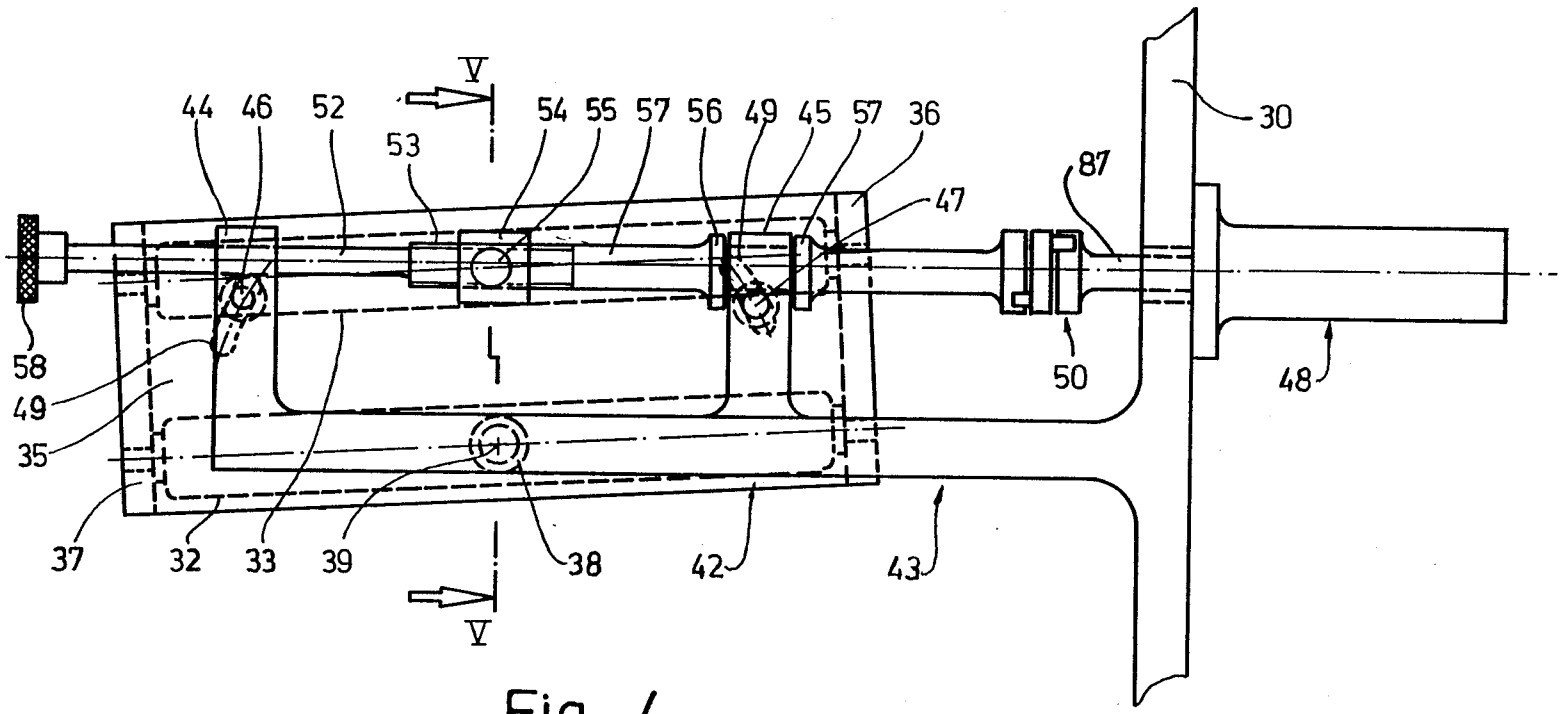
FIG. 4 shows a side view of a web-adjusting member for an individual (material) web.
Figure 5:
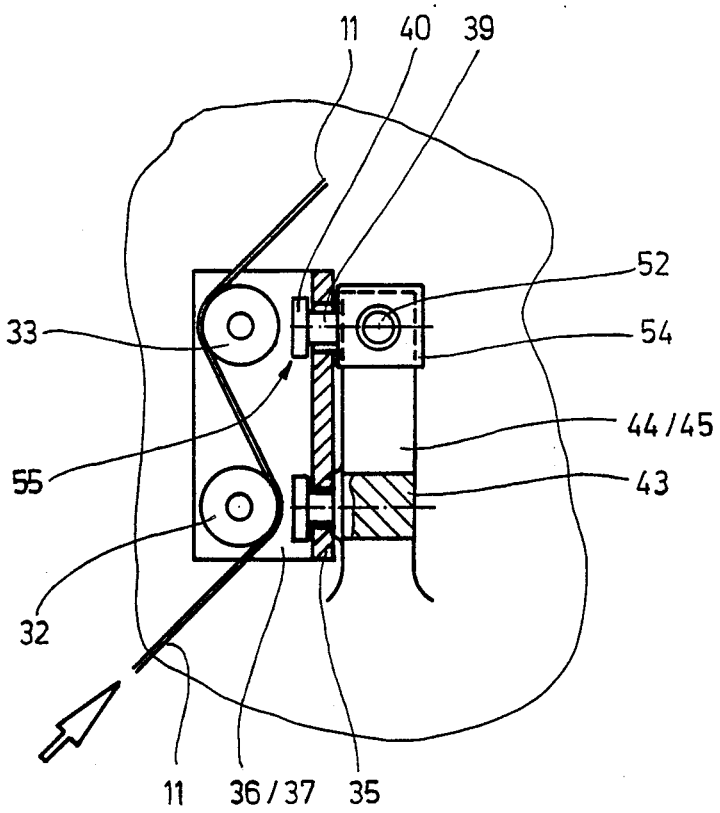
FIG. 5 shows a cross-section of the detail according to FIG. 4 in the sectional plane V—V.
Figure 6:
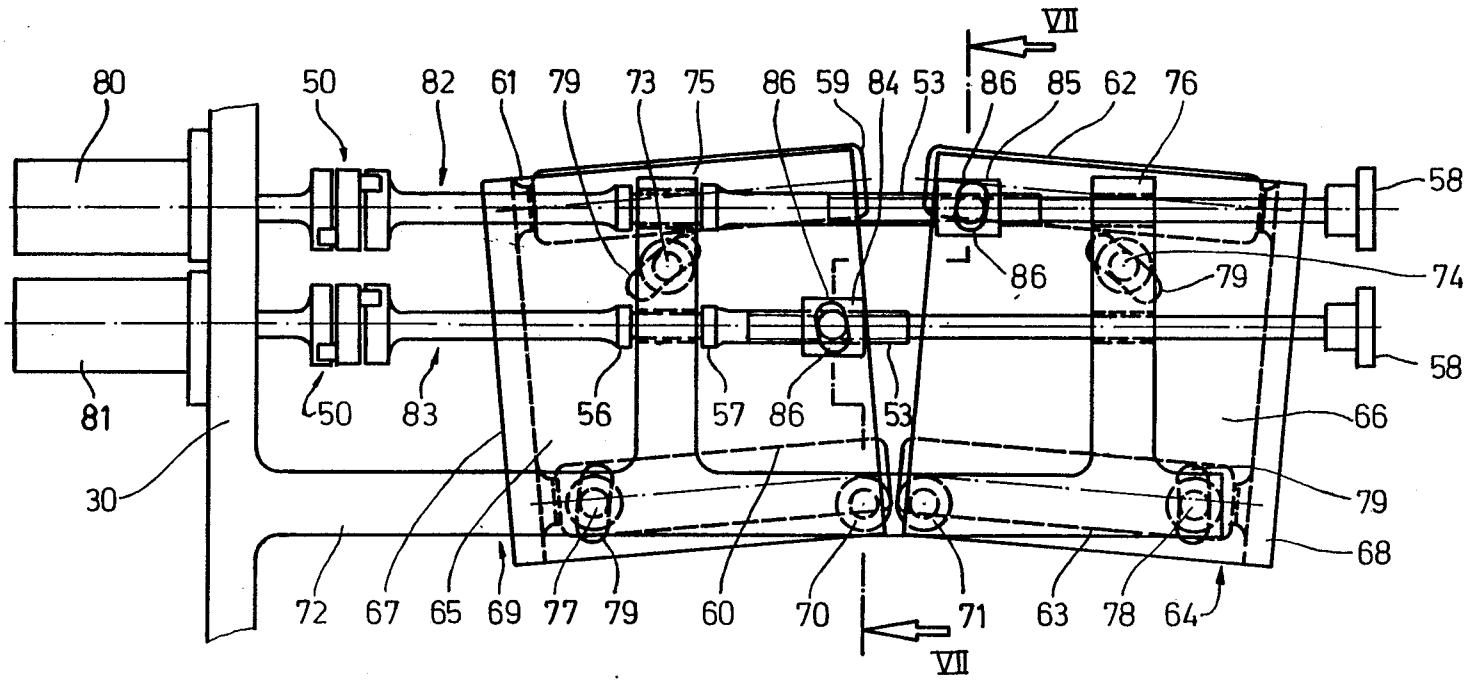
FIG. 6 shows a web-adjusting member for two (part) webs in a representation corresponding to that of FIG. 4.
Figure 7:
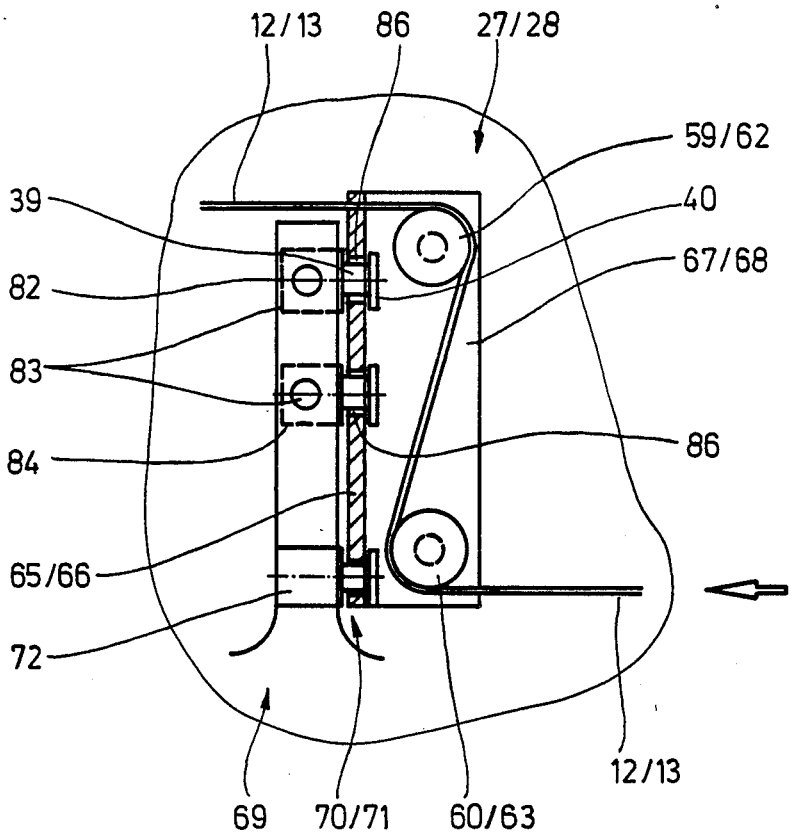
FIG. 7 shows a cross-section through the detail according to FIG. 6 in the sectional plane VII—VII.

The roller-carriers 61 and 64 so designed are mounted on a common supporting frame 69 so as each to be adjustable or pivotable independently. A pivot bearing 70, 71 connecting the roller-carriers 61, 64 to a supporting arm 72 of the supporting frame 69 is located at the lower or outer edge of the supporting plate 65, 66, in particular in a corner adjacent to the other particular supporting plate. In a similar way to the exemplary embodiment according to FIG. 4 and 5, these pivot bearings 70, 71 are arranged in the region of the leading deflecting rollers 60, 63, that is to say those first touched by the part webs 12, 13. In this region, therefore, the distance between the supporting plates 65, 66 remains essentially unchanged during regulating movements, whilst the supporting plates 65, 66 opening out from one another to the opposite deflecting rollers 59, 62 are here at a longer distance from one another, as are consequently also deflecting rollers 59, 62.

On the one hand, this purpose is served by connecting bolts 73 and 74 in the region of supporting legs 75, 76 which are upright or are directed transversely relative to the supporting arm 69. On the other hand, this purpose is served by further connecting bolts 77 and 78 which make a connection with the supporting frame 69 in the region of the supporting arm 72. The connecting bolts 73, 74 and 77 and 78 act concentrically relative to the pivot bearing 70, 71 respectively via arcuate long holes 79.

Separate servo-motors 80, 81 serve for adjusting one roller-carrier 61, 64 or the other. In a similar way to the exemplary embodiment of FIGS. 4 and 5, these act on separate spindle rods 82, 83 each assigned to a roller-carrier 61, 64. The two are mounted rotatably in or on the supporting legs 75, 76, specifically at a distance from one another. Assigned to each spindle rod 82, 83 is a spindle nut 84, 85 connected to one of the supporting plates 65, 66. These spindle nuts are therefore likewise arranged offset on the supporting plates 65, 66. Because of the above-described relative positions of the movable and stationary members, the spindle nuts 84, 85 are also assigned long holes 86. These allow a constraint-free adjustment of the supporting plates 65, 66.

Also with regard to the web-adjusting members 27, 28 for the part webs 12 and 13, the latter are guided round the deflecting rollers 59, 60 and 62, 63 in the same way already described, in particular with a diagonally extending region between the deflecting rollers.

Figure 3:
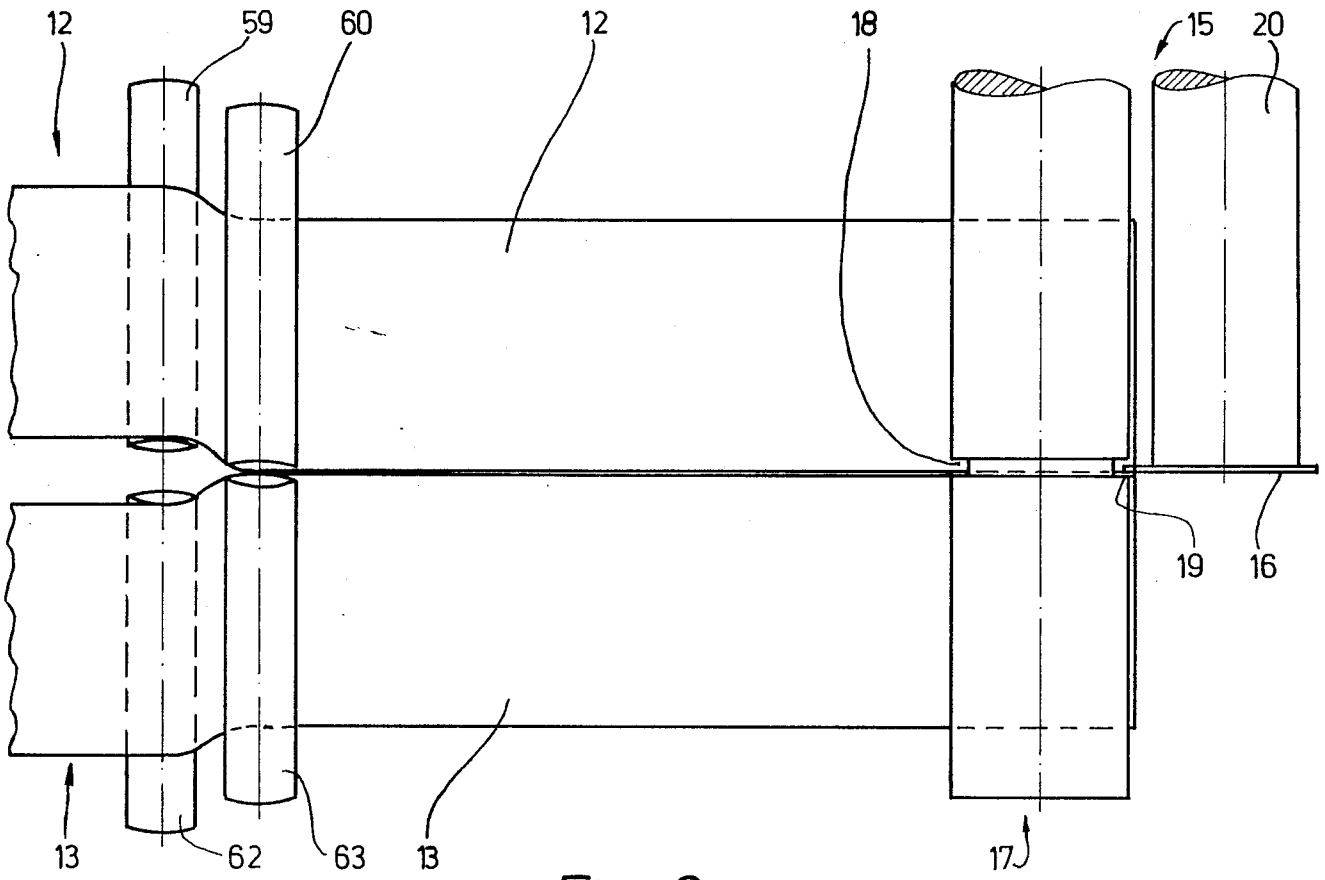
FIG. 3 shows a plan view of a cutout of the apparatus on a further-enlarged scale.

The above-described design of the web-adjusting members 27, 28 and their relative arrangement afford a particular advantage for the guidance of the part webs 12 and 13. As is evident from FIG. 3, after the severing cut has been made the part webs 12, 13 continue to run parallel and next to one another, without spreading apart in the conveying direction. This is possible because of the close proximity of the equiaxially arranged deflecting rollers 60 and 63 which, as a result of their oblique position, cause a tilting of the part webs 12, 13, so that these are directed in a roof-shaped manner relative to one another. The diverging guidance of the part webs 12, 13 takes place in the region between the deflecting rollers 60 and 59 on the one hand and 63 and 62 on the other hand. Undesirable tensions in the part webs 12, 13 after the severing unit 15 are thereby prevented. The part webs 12, 13, after leaving their web-adjusting members 27, 28, are at the necessary distance from one another. For this purpose, as described, the deflecting rollers 60, 63 on the one hand and 59, 62 on the other hand are also directed in a roof-shaped manner relative to one another in the normal position.

What is claimed is:

1. Apparatus for continuously separating a conveyed web of material into at least two part webs, in conjunction with a packaging machine, comprising:

three web-adjusting member means (24, 27, 28) comprising three pairs of deflecting rollers (32, 33; 59, 60; 62, 63), respectively; the deflecting rollers of each pair being spaced from one another and being rotatably mounted on one of three adjustably pivotable common roller-carriers (34, 61, 64), one roller-carrier being for guiding the web (11), and two roller-carriers being for guiding said part webs (12, 13), respectively;

web-monitoring members for controlling the positions of the three roller-carriers (34, 61, 64);

wherein the two pairs of deflecting rollers (59 and 60 or 62 and 63) mounted respectively on said two roller-carriers (61, 64) are mounted in such a relative position in relation to one another that the two leading deflecting rollers (60 and 63) of said two pairs of deflecting rollers are arranged at a short distance from one another, while the trailing deflecting rollers (59, 62) of said two pairs of deflecting rollers are arranged at a longer distance from one another; and wherein said two roller-carriers (61, 64) are arranged on a common supporting frame (69) and are respectively adjustable by means of separate regulating gears in the form of servo-motors (80, 81) and spindle rods (82, 83).

2. Apparatus according to claim 1, characterized in that each roller-carrier (34, 61, 64) is mounted pivotably on the supporting frame (42, 69) connected to a machine cheek (30), each roller-carrier (34, 61, 64) being connected to the supporting frame (42, 69) not only via a pivot bearing (38, 70, 71), but also via two connecting bolts (46, 47; 73, 74; 77, 78) by means of elongated hole guides (79).

3. Apparatus according to claim 2, characterized in that each spindle rod (52) is mounted rotatably on the supporting frame (42, 69), on supporting legs (44, 45) arranged at a distance from one another.

4. Apparatus according to claim 1, characterized in that the deflecting rollers (32, 33; 59, 60; 62, 63) of each pair are additionally adjustable by hand, via a handwheel (58) arranged on each spindle rod.

5. Apparatus according to claim 1, characterized in that said deflecting rollers (59, 60 and 62, 63) are respectively mounted on one side in an overhanging manner, on bearing flanges (67, 68) extending on mutually distant sides of said two roller-carriers (61, 64).

6. Apparatus according to claim 1, characterized in that pivot bearings (70, 71) for said two roller-carriers (61, 64) are arranged on the leading side in the region of mutually confronting corners of said two roller-carriers (61, 64).

7. Apparatus according to claim 1, comprising:

a severing unit (15) for separating said conveyed web of material (11) into two part webs (17, 13); and web-monitoring members for controlling the positions of the three roller-carriers (34, 61, 64), said web monitoring means comprising separate edge-sensing members (21, 25, 26) for the web (11) and the two part webs (12, 13), respectively, the edge-sensing member (21) for the web (11) being located in front of the severing unit (15) in the conveying direction of the web (11).

8. Apparatus according to claim 7, characterized in that the edge-sensing members (21, 25, 26) are arranged on the same side of the web of material (11) and of the part webs (12, 13).

9. Apparatus according to claim 1, characterized in that the two deflecting rollers (32, 33; 59, 60; 62, 63) of each web-adjusting member means (24, 27, 28) describe different movements for the execution of adjusting movements, in such a way that the leading deflecting roller (32, 60, 63), receiving the web of material or part web, has a smaller amount of movement than the other deflecting roller (33, 59, 62) of each pair of deflecting rollers.

10. Apparatus according to claim 9, characterized in that each roller-carrier (34, 61, 64) is pivotable about a respective eccentric pivot bearing (38, 70, 71) which is arranged in the region of the leading deflecting roller (32, 60, 63) of each pair of deflecting rollers.

* * * * *